US005984211A

United States Patent [19]

Sugimoto et al.

[11] Patent Number: 5,984,211

[45] Date of Patent: Nov. 16, 1999

[54] FUEL INJECTION VALVE FOR AN INTERNAL COMBUSTION ENGINE

[75] Inventors: Tomojiro Sugimoto, Susono; Keiso Takeda, Mishima, both of Japan

[73] Assignee: Toyota Jidosha Kabushiki Kaisha, Aichi-Ken, Japan

[21] Appl. No.: 09/094,257

[22] Filed: Jun. 9, 1998

[30] Foreign Application Priority Data

Jun. 20, 1997 [JP] Japan ..... 9-164604

[51] Int. Cl.[6] ..... B05B 1/30; B05B 1/14

[52] U.S. Cl. ..... 239/596; 239/533.12; 239/533.14; 239/553; 239/553.5; 239/590; 239/590.5; 251/127

[58] Field of Search ..... 239/533.3, 533.11, 239/533.12, 533.14, 553, 553.3, 553.5, 590, 590.3, 590.5, 596, 556, 558; 251/127, 324

[56] References Cited

U.S. PATENT DOCUMENTS

| | | | |
|---|---|---|---|
| 4,057,190 | 11/1977 | Kiwior et al. | 239/558 |
| 4,621,772 | 11/1986 | Blythe et al. | 239/585 |
| 5,174,505 | 12/1992 | Shen | 239/590 X |
| 5,193,747 | 3/1993 | Pressner | 239/533.12 X |
| 5,207,383 | 5/1993 | Hans et al. | 239/533.12 X |
| 5,263,648 | 11/1993 | Vogt et al. | 239/533.14 X |
| 5,570,841 | 11/1996 | Pace et al. | 239/533.12 X |
| 5,636,796 | 6/1997 | Oguma | 239/533.12 |
| 5,823,444 | 10/1998 | Reiter et al. | 239/533.12 |

FOREIGN PATENT DOCUMENTS

| | | |
|---|---|---|
| 61-135979 | 6/1986 | Japan . |
| 7-127550 | 5/1995 | Japan . |
| 9-32695 | 2/1997 | Japan . |

*Primary Examiner*—Kevin P. Shaver
*Assistant Examiner*—Robin O. Evans
*Attorney, Agent, or Firm*—Kenyon & Kenyon

[57] ABSTRACT

A valve seat portion has fuel flow passages arranged between guide portions at predetermined intervals along an outer circumference of a valve body. In addition, a fuel jet adjusting plate has nozzle holes arranged along a circle coaxial with the outer circumference of the valve body, the nozzle holes corresponding to the guide portions. Therefore, even if the valve body rotates circumferentially relative to the valve seat portion, no alteration in the pressure applied to fuel flowing through the nozzle holes occurs. By suitably setting relative locations between the respective nozzle holes and the guide portions and the numbers thereof, the pressure applied to fuel injected from the respective nozzle holes is adjusted, whereby the fuel injected from the respective nozzle holes is optimally atomized.

5 Claims, 6 Drawing Sheets

FUEL INJECTION VALVE FOR AN INTERNAL COMBUSTION ENGINE

INCORPORATION BY REFERENCE

The disclosure of Japanese Patent Application No. HEI 9-164604 filed on Jun. 20, 1997 including the specification, drawings and abstract is incorporated herein by reference in its entirety.

FIELD OF THE INVENTION

The present invention relates to a fuel injection valve for an internal combustion engine.

BACKGROUND OF THE INVENTION

A fuel injection valve for an internal combustion engine as illustrated in FIGS. 7, 8 and 9 is conventionally known. This conventional fuel injection valve includes a thin fuel jet adjusting plate having orifices (nozzle holes), a valve body having fuel flow passages for allowing fuel to flow therethrough, and a valve seat portion for slidably guiding a valve body in axial directions. FIG. 7 is a partial sectional side view of the fuel jet adjusting plate, the valve body and the valve seat portion of the conventional fuel injection valve for an internal combustion engine. FIG. 8 illustrates only the fuel jet adjusting plate and the valve seat portion viewed as indicated by an arrow VII in FIG. 7. FIG. 9 is a sectional view taken along line IX—IX in FIG. 7. As illustrated in FIGS. 7, 8 and 9, the valve seat portion is denoted by reference character 101, the fuel flow passages by 102, guide portions by 103, a guide surface by 104, the fuel jet adjusting plate by 105, the orifices (nozzle holes) by 106, the valve body by 107, and sliding surfaces by 108. The valve seat portion 101 includes the guide surface 104 which slidably guides the valve body 107. In this case, the sliding surface 108 of the valve body 107 is closely fitted to the guide surface 104 of the valve seat portion 101. Thus, the valve body 7 can move in top-to-bottom directions in FIG. 7 and assume either an open position or a closed position. Furthermore, the valve body 107 has the fuel flow passages 102 formed among the respective sliding surfaces 108. Thus, while the valve body 107 is securely guided with its sliding surfaces 108 closely fitted to the guide surface 104 of the valve seat portion 101, fuel can flow through the fuel flow passages 102 from top to bottom in FIG. 7. Thus, when the valve body 107 assumes the open position, fuel flowing through the fuel flow passages 102 is injected from the orifices 106 formed in the fuel jet adjusting plate 105. This type of fuel injection valve for an internal combustion engine is disclosed, for instance, in Japanese Patent Application Laid-Open No. HEI 7-127550.

In the case of the aforementioned fuel injection valve, however, the guide surface 104 and the sliding surfaces 108 allow the valve body 107 to slide relative to the valve seat portion 101. Thereby, the valve body 107 may not only move relative to the valve seat portion 101 in top-to-bottom directions in FIG. 7 but may also rotate circumferentially relative to the valve seat portion 101 (as indicated by an arrow A in FIG. 9). If the valve body 107 rotates relative to the valve seat portion 101, the fuel flow passages 102 attached to the valve body 107 also rotate circumferentially relative to the orifices 106 formed in the fuel jet adjusting plate 105 attached to the valve seat portion 101. This change in relative location between the fuel flow passages 102 and the orifices 106 causes alterations in pressures applied to fuel flowing through the respective orifices 6, flow rates of the fuel injected therefrom and the state of atomization of the fuel thus injected. As a result, the performance of an internal combustion engine on which the fuel injection valve is mounted is adversely affected.

In order to solve the aforementioned problems, according to another known fuel injection valve for an internal combustion engine, it is not a valve body but a valve seat portion that is equipped with fuel flow passages. FIG. 10 is a top view illustrating only a fuel jet adjusting plate and the valve seat portion of this known fuel injection valve having a valve seat portion equipped with fuel flow passages. FIG. 11 is a sectional view of the fuel injection valve taken along line XI—XI in FIG. 10, with a valve body mounted on the fuel injection valve. Referring to FIGS. 10 and 11, the valve seat portion is denoted by reference character 201, the fuel flow passages by 202, a guide portion by 203, a guide surface by 204, the fuel jet adjusting plate by 205, orifices (nozzle holes) by 206, the valve body by 207, and a sliding surface by 208. The fuel injection valve as illustrated in FIGS. 10 and 11 is different from the aforementioned fuel injection valve in that it is not the valve body 207 but the valve seat portion 201 that is equipped with the fuel flow passages 202. Thus, even if the valve body 207 rotates circumferentially relative to the valve seat portion 201, the orifices 206 do not rotate relative to the fuel flow passages. Thus, rotation of the valve body 207 does not cause any alteration in the pressure applied to fuel flowing through the respective orifices 206, flow rates of the fuel injected therefrom, and a state of atomization of the fuel thus injected. As a result, the performance of an internal combustion engine on which the fuel injection valve is mounted is not adversely affected.

Although the fuel flow passages 202 do not move relative to the orifices 206 in the aforementioned fuel injection valve, a relationship between the fuel flow passages 202 and the orifices 206 such as circumferential location of the orifices 206 relative to the fuel flow passages 202 and the number of the orifices 206 is not determined to obtain optimal atomization of injected fuel. For example, the pressure applied to the fuel flowing downstream of the fuel flow passages 202 is higher than that applied to the fuel flowing downstream of the guide portions 3. Thus, in the case where the orifices 206 located downstream of the fuel flow passages 202 and the orifices 206 located downstream of the guide portions 203 are arranged along the same circle, there is a difference in the state of atomization between the fuel injected from the orifices 206 located downstream of the fuel flow passages 202 and the fuel injected from the orifices 206 located downstream of the guide portions 203. Therefore, the state of atomization of fuel injected from the fuel injection valve depends on how the fuel injection valve is mounted on the internal combustion engine and depends more particularly on a circumferential rotation of the fuel injection valve. Nevertheless, the aforementioned fuel injection valve does not take this into account. In other words, since this fuel injection valve does not consider respective circumferential locations of the orifices 206 relative to the fuel flow passages 202 and the guide portions 203, the number of orifices 206 and so forth, a difference arises between the state of atomization in the respective orifices 206. In the aforementioned fuel injection valve, the respective orifices 206 are not arranged such that the fuel injected from the fuel injection valve is uniformly atomized. Hence, the fuel injected from the fuel injection valve is not uniformly atomized around a circumference thereof. Consequently, the state of atomization of injected fuel is not optimized.

SUMMARY OF THE INVENTION

The present invention has been devised in consideration of the aforementioned problems. It is an object of the present invention to provide a fuel injection valve which, despite its ability to rotate relative to an internal combustion engine, is capable of optimizing atomization of injected fuel such that the fuel injected from nozzle holes is uniformly atomized without any alteration in the pressure applied to fuel flowing through the various nozzle holes, flow rates of the fuel injected therefrom and a state of atomization of the fuel thus injected.

In order to achieve the aforementioned object, a first aspect of the present invention provides a fuel injection valve including a valve body driven by driving means, a valve seat portion having a plurality of guide portions arranged among the circumference of said valve body for slidably guiding the valve body and a plurality of fuel flow passages arranged between the guide portions for allowing fuel to flow therethrough, a fuel jet adjusting plate arranged downstream of the valve seat portion and attached thereto, and a plurality of first nozzle holes arranged along a first circle on the fuel jet adjusting plate, each first nozzle hole corresponding to a respective one of the guide portions, wherein the first circle is coaxial with an outer circumference of the valve body.

In a second aspect of the present invention, the fuel injection valve according to the first aspect may further include a plurality of second nozzle holes arranged along the first circle on the fuel jet adjusting plate, each second nozzle hole corresponding to a respective one of the fuel flow passages.

In a third aspect of the present invention, the fuel injection valve according to the first aspect may further include a plurality of second nozzle holes arranged along a second circle concentric with the first circle and having a diameter smaller than that of the first circle.

In a fourth aspect of the present invention, the fuel injection valve according to the first aspect may further include a plurality of second nozzle holes arranged along a second circle concentric with the first circle and having a diameter larger than that of the first circle.

According to the first aspect of the present invention, it is not the valve body but the valve seat portion that is equipped with the fuel flow passages. Thus, even if the valve body rotates relative to the valve seat portion, no alteration occurs in the pressure applied to fuel flowing through the orifices, flow rates of the fuel injected therefrom and a state of atomization of the fuel thus injected. Also, the nozzle holes are arranged on the first circle corresponding to the guide portions. Thus, fuel is injected from the respective nozzle holes under equal pressure, whereby the fuel injected from the nozzle holes of the fuel injection valve is uniformly atomized. As a result, it is possible to optimize atomization of the fuel injected from all the nozzle holes.

According to the second and third aspects of the present invention, the first and second nozzle holes, which are arranged along the first and second circles, correspond to the guide portions and the fuel flow passages, respectively. While fuel is injected from the first nozzle holes under an equal pressure, fuel is also injected from the second nozzle holes under an equal pressure. The fuel flow passages are arranged between the respective guide portions and the second nozzle holes and the first nozzle holes are alternately arranged at predetermined intervals along the second and first circles, respectively. Hence, the fuel injected from all of the first and second nozzle holes is uniformly atomized. Thus, the second and third aspects of the present invention enable optimal atomization of injected fuel.

According to the fourth aspect of the present invention, the fuel flowing downstream of the guide portions reaches the first nozzle holes and is then injected from the first nozzle holes under increased pressure. Hence, the pressure applied to the fuel injected from the first nozzle holes is substantially equal to that applied to the fuel injected from the second nozzle holes. Hence, the fuel injected from all of the first and second nozzle holes of the fuel injection valve is uniformly atomized. As a result, it is possible to optimize atomization of injected fuel.

Furthermore, in the first to fourth aspects of the present invention, the guide portions may be arranged at predetermined intervals along the valve seat portion and the nozzle holes may be arranged at predetermined intervals along the outer circumference of the valve body. In this manner, the pressure applied to the fuel injected from the first nozzle holes and the pressure applied to the fuel injected from the second nozzle holes can further be equalized. Hence, it is possible to easily adjust atomization of the fuel injected from the nozzle holes.

BRIEF DESCRIPTION OF THE DRAWINGS

Further objects, features and advantages of the present invention will become apparent from the following description of preferred embodiments with reference to the accompanying drawings, wherein.

DESCRIPTION OF PREFERRED EMBODIMENTS

Preferred embodiments of the present invention will hereinafter be described with reference to the accompanying drawings.

Figure 1:
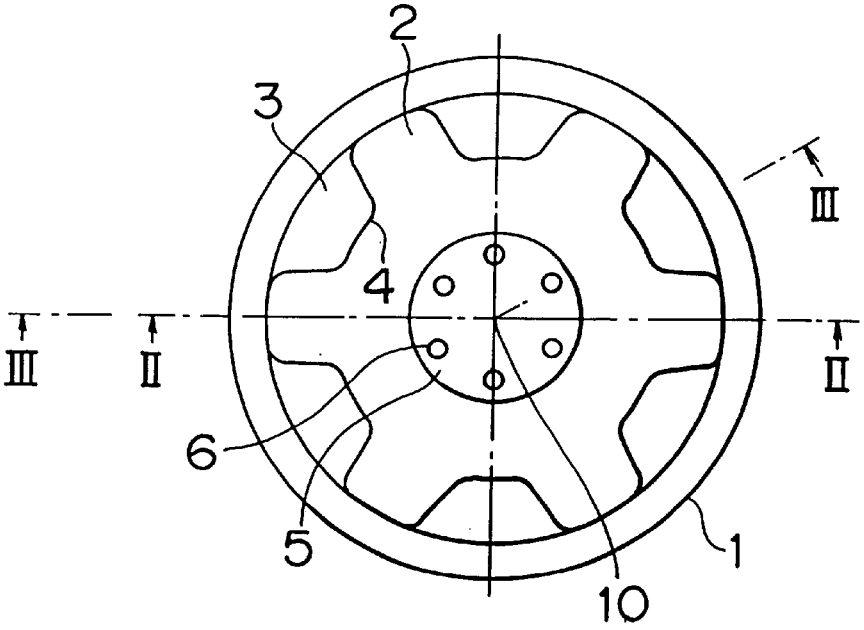
FIG. 1 is a top view of a fuel jet adjusting plate and a valve seat portion of a fuel injection valve according to a first embodiment of the present invention.
Figure 2:
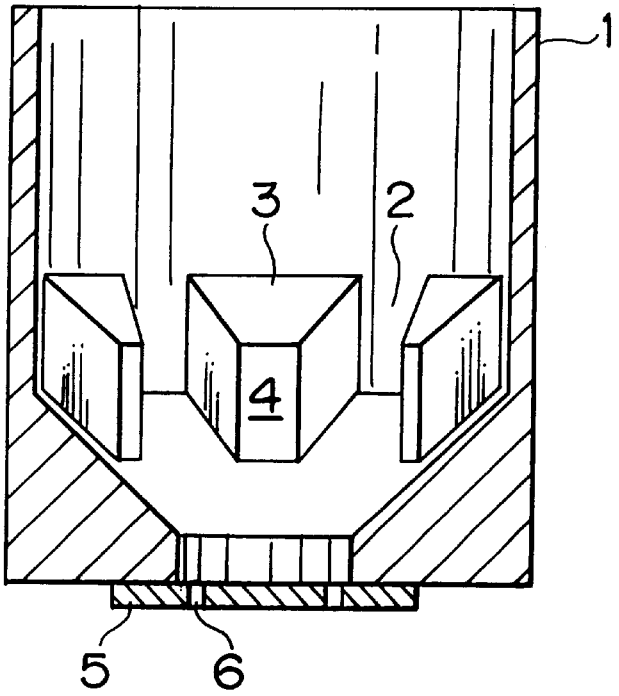
FIG. 2 is a sectional view taken along line II—II in FIG. 1.
Figure 3:
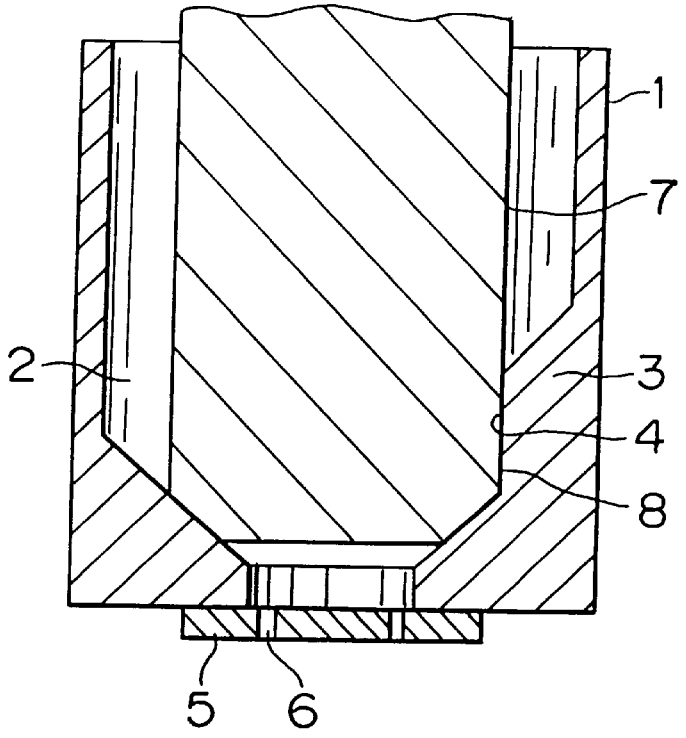
FIG. 3 is a sectional view taken along line III—III in FIG. 1 and illustrates the fuel injection valve with a valve body mounted thereon.

FIG. 1 is a top view of a fuel jet adjusting plate and a valve seat portion of a fuel injection valve according to a first embodiment of the present invention. FIG. 2 is a sectional view taken along line II—II in FIG. 1. FIG. 3 is a sectional view taken along line III—III in FIG. 1 and illustrates the fuel injection valve with a valve body mounted thereon. Referring to FIGS. 1, 2 and 3, the valve seat portion is denoted by reference character 1, fuel flow passages by 2, guide portions by 3, a guide surface by 4, the fuel jet adjusting plate by 5, orifices (nozzle holes) by 6, a valve body by 7 and a sliding surface by 8.

As illustrated in FIGS. 1, 2 and 3, the valve seat portion 1 has the guide portions 3 each provided with the guide surface 4 for slidably guiding the valve body 7. The guide portions 3 are arranged at predetermined intervals along an outer periphery of the valve body 7. On the other hand, the valve body 7 has the sliding surface 8 which can slide along the guide surface 4 of the valve seat portion 1. In addition, the valve body 7 is caused to move by driving means (not shown) from top to bottom in FIG. 3, whereby the valve body 7 assumes either a closed position (FIG. 3) or an open position (not shown) according to the occasion.

Furthermore, the valve seat portion 1 has the fuel flow passages 2 through which fuel flows, the fuel flow passages 2 being arranged among the guide portions 3 along the outer periphery of the valve body 7. Thus, while the valve body 7 is securely guided with its sliding surface 8 closely fitted to the guide surface 4 of the valve seat portion 1, fuel can flow through the fuel flow passages 2 from top to bottom in FIG. 3. The fuel jet adjusting plate 5 is disposed on a downstream portion of the valve seat portion 1 in order to adjust a state of fuel injected from the fuel injection valve. The fuel jet adjusting plate 5 is attached to the valve seat portion 1 by fixing means (not shown). In addition, the fuel jet adjusting plate 5 has the orifices 6. Thus, when the valve body 7 assumes the open position, fuel flowing through the fuel flow passages 2 is injected from the orifices 6 formed in the fuel jet adjusting plate 5.

As described above, in this embodiment, it is not the valve body 7 but the valve seat portion 1 that is equipped with the fuel flow passages 2. Thus, even if the valve body 7 rotates about a central axis 10 thereof relative to the valve seat portion 1, the orifices 6 do not move relative to the fuel flow passages 2. Therefore, no alteration occurs in the pressure applied to fuel flowing through the respective orifices 6, flow rates of the fuel injected therefrom and a state of atomization of the fuel thus injected.

Furthermore, in this embodiment, the orifices 6 are arranged along a circle coaxial with an outer circumference of the valve body 7. In this case, each of the orifices 6 is allocated to a plane passing the central axis 10 of the valve body 7 and each of the guide portions 3. That is, the orifices 6 are arranged at predetermined intervals along the circle coaxial with the outer circumference of the valve body 7, each of the orifices 6 corresponding to a respective one of the guide portions 3. Hence, the fuel injected from the respective orifices 6 of the fuel injection valve is uniformly atomized. As a result, it is possible to optimize atomization of injected fuel.

Figure 4:
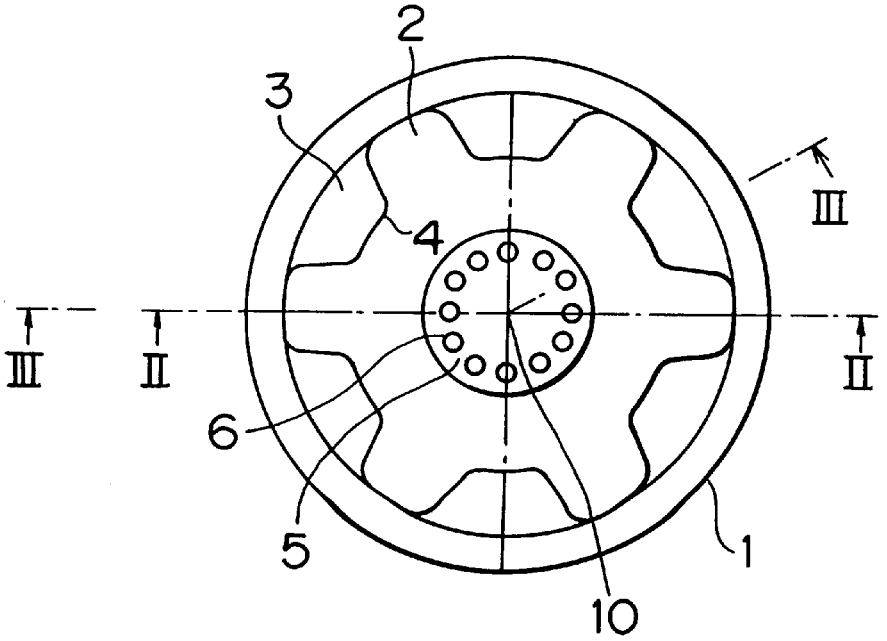
FIG. 4 is a top view of the fuel jet adjusting plate and the valve seat portion of the fuel injection valve according to a second embodiment of the present invention.

FIG. 4 is a top view of the fuel jet adjusting plate and the valve seat portion of the fuel injection valve according to a second embodiment of the present invention. In FIGS. 4 and 1, like components or parts are denoted by like reference characters. Since this embodiment is different from the first embodiment only in arrangement of the orifices 6, the following description will be made only as to the arrangement of the orifices 6 as well as the accompanying operation and effect.

In this embodiment, the orifices 6 are arranged along the circle coaxial with the outer circumference of the valve body 7. In addition, each of the orifices 6 is allocated either to a plane passing through the central axis 10 and a respective one of the guide portions 3 or to a plane passing through the central axis 10 of the valve body 7 and a respective one of the fuel flow passages 2. That is, the orifices 6 are arranged along the circle coaxial with the outer circumference of the valve body 7, each of the orifices 6 corresponding either to a respective one of the guide portions 3 or to a respective one of the fuel flow passages 2.

The pressure applied to the fuel flowing downstream of the fuel flow passages 2 is higher than that applied to the fuel flowing downstream of the guide portions 3. Thus, the pressure applied to the fuel injected from the orifices 6 corresponding to the guide portions 3 is different from that applied to the fuel injected from the orifices 6 corresponding to the fuel flow passages 2. However, while fuel is injected from the orifices 6 corresponding to the guide portions 3 under an equal pressure, fuel is also injected from the orifices 6 corresponding to the fuel flow passages 2 under an equal pressure. The fuel flow passages 2 and the guide portions 3 are alternately arranged along a circumference of the valve seat portion 1. Thus, the orifices 6 corresponding to the fuel flow passages 2 and the orifices 6 corresponding to the guide portions 3 are alternately arranged at predetermined intervals along the circle coaxial with the outer circumference of the valve body 7. Hence, the fuel injected from all the orifices 6 of the fuel injection valve is uniformly atomized. In this manner, this embodiment provides optimal atomization of the fuel injected from the orifices 6.

Figure 5:
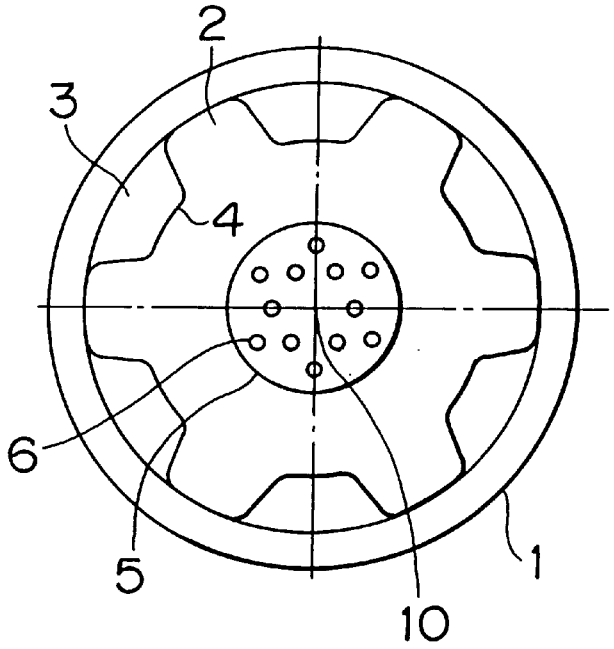
FIG. 5 is a top view of the fuel jet adjusting plate and the valve seat portion of the fuel injection valve according to a third embodiment of the present invention.

FIG. 5 is a top view of the fuel jet adjusting plate and the valve seat portion of the fuel injection valve according to a third embodiment of the present invention. In FIGS. 5 and 1, like components or parts are denoted by like reference characters. Since this embodiment is different from the first embodiment only in arrangement of the orifices 6, the following description will be made only as to the arrangement of the orifices 6 as well as the accompanying operation and effect.

In this embodiment, the orifices 6 are respectively arranged at predetermined intervals along a first circle coaxial with the outer circumference of the valve body 7 and along a second circle concentric with the first circle and having a diameter smaller than that of the first circle. Furthermore, each of the orifices 6 arranged along the first circle is allocated to a plane passing through the axis 10 of the valve body 7 and a respective one of the guide portions 3. On the other hand, each of the orifices 6 arranged along the second circle is allocated to a plane passing through the axis 10 of the valve body 7 and a respective one of the fuel flow passages 2. That is, while each of the orifices 6 arranged at predetermined intervals along the first circle corresponds to a respective one of the guide portions 3, each of the orifices 6 arranged at predetermined intervals along the second circle corresponds to a respective one of the fuel flow passages 2.

In addition to the fact that the pressure applied to the fuel flowing downstream of the fuel flow passages 2 is higher than that applied to the fuel flowing downstream of the guide portions 3, the pressure applied to fuel flowing upstream of the fuel jet adjusting plate 5 is higher at a location distant from the central axis 10 of the valve body 7 than at a (radially inward) location near the central axis 10. Hence, the pressure applied to the fuel injected from the respective orifices 6 along the first circle, corresponding to the guide portions 3, is lower than that applied to the fuel injected from the respective orifices 6 along the second circle, corresponding to the fuel flow passages 2. However, while fuel is injected from the orifices 6 along the first circle, corresponding to the guide portions 3 under an equal pressure, fuel is also injected from the orifices 6 along the second circle, corresponding to the fuel flow passages 2, under an equal pressure. The fuel flow passages 2 and the guide portions 3 are alternately arranged along the circumference of the valve seat portion 1. Thus, the orifices 6 corresponding to the fuel flow passages 2 and the orifices 6 corresponding to the guide portions 3 are alternately arranged at predetermined intervals along the circumference of the valve body 7. Hence, the fuel injected from all the orifices 6 of the fuel injection valve is uniformly atomized. In this manner, this embodiment provides optimal atomization of the fuel injected from the orifices 6.

Figure 6:
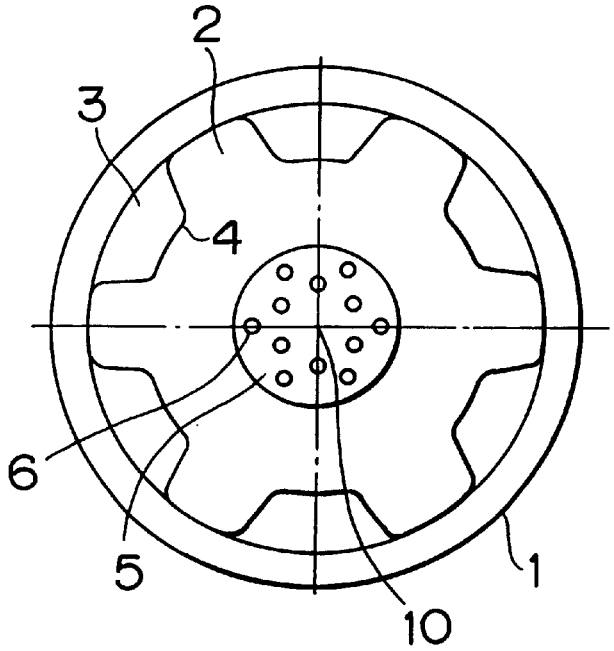
FIG. 6 is a top view of the fuel jet adjusting plate and the valve seat portion of the fuel injection valve according to a fourth embodiment of the present invention.
Figure 7:
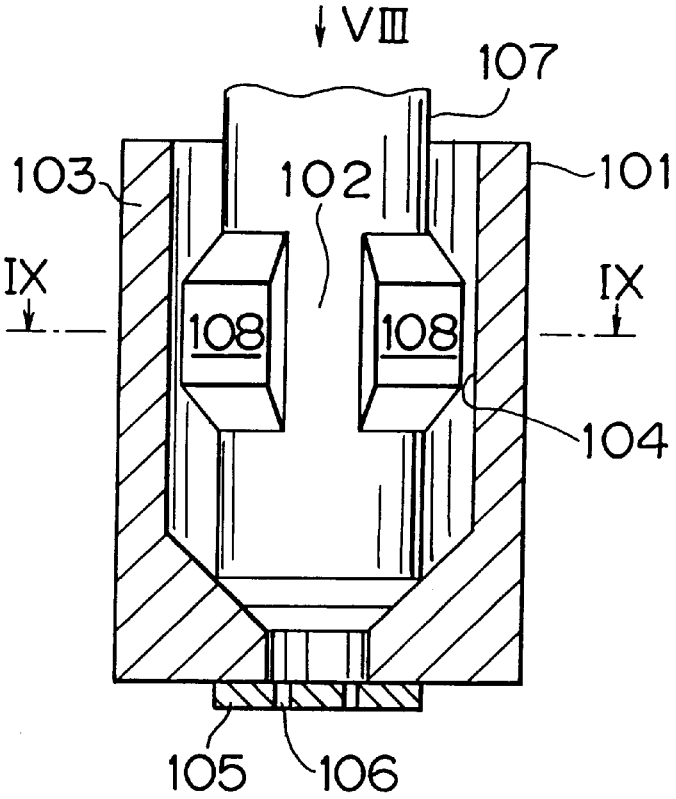
FIG. 7 RELATED ART
FIG. 7 is a partial sectional side view of a fuel jet adjusting plate, a valve body and a valve seat portion of a conventional fuel injection valve.
Figure 8:
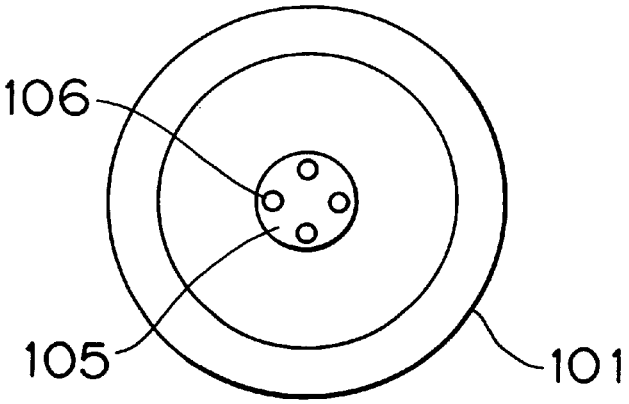
FIG. 8 RELATED ART
FIG. 8 illustrates only the fuel jet adjusting plate and the valve seat portion as viewed as indicated by an arrow in FIG. 7.
Figure 9:
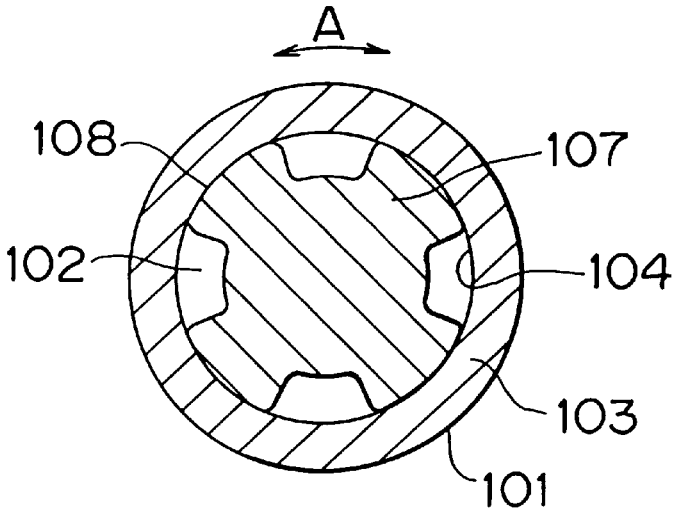
FIG. 9 RELATED ART
FIG. 9 is a sectional view taken along line IX—IX in FIG. 7.
Figure 10:
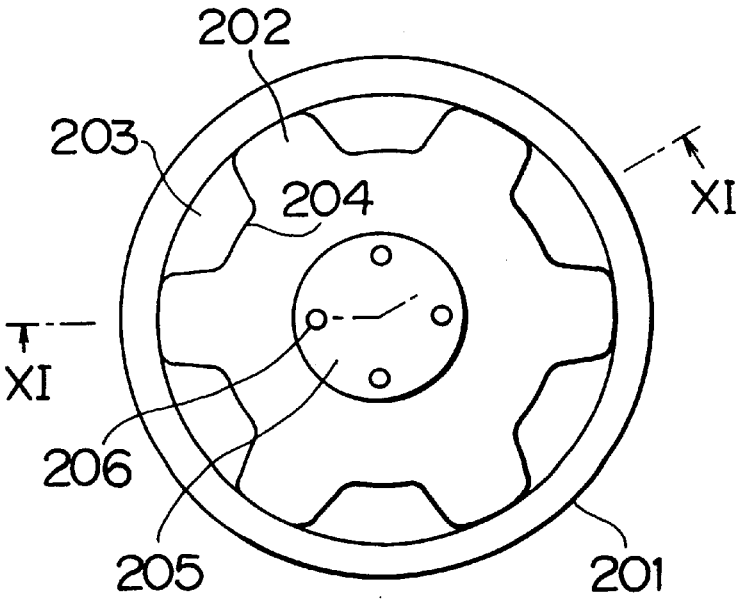
FIG. 10 RELATED ART
FIG. 10 is a top view of a fuel jet adjusting plate and a valve seat portion of a known fuel injection valve, the valve seat portion being equipped with fuel flow passages.
Figure 11:
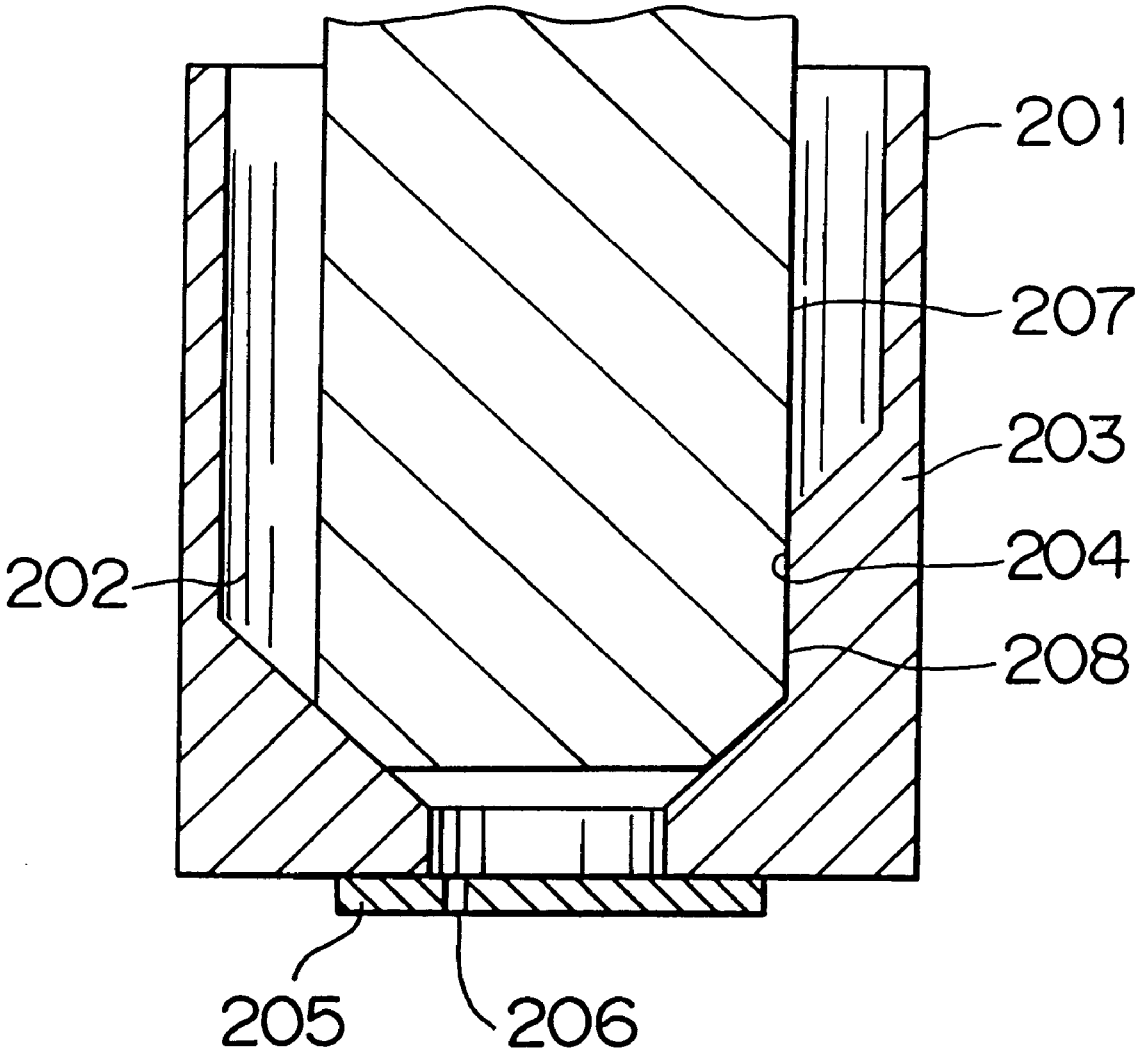
FIG. 11 RELATED ART
FIG. 11 is a sectional view of the fuel injection valve taken along line XI—XI in FIG. 10, with a valve body mounted on the fuel injection valve.

FIG. 6 is a top view of the fuel jet adjusting plate and the valve seat portion of the fuel injection valve according to a fourth embodiment of the present invention. In FIGS. 6 and 1, like components or parts are denoted by like reference characters. Since this embodiment is different from the first embodiment only in arrangement of the orifices 6, the following description will be made only as to the arrangement of the orifices 6 as well as the accompanying operation and effect.

In this embodiment, the orifices 6 are respectively arranged at predetermined intervals along the first circle coaxial with the outer circumference of the valve body 7 and along a second circle concentric with the first circle and having a larger diameter than the first circle. Furthermore, each of the orifices 6 along the first circle is allocated to a plane passing through the central axis 10 and a respective one of the guide portions 3. On the other hand, each of the orifices 6 arranged along the second circle is allocated to a plane passing through the axis 10 of the valve body 7 and a respective one of the fuel flow passages 2. That is, while each of the orifices 6 arranged at predetermined intervals along the first circle corresponds to a respective one of the guide portions 3, each of the orifices 6 arranged at predetermined intervals along the second circle corresponds to a respective one of the fuel flow passages 2.

As described above, the pressure applied to the fuel flowing downstream of the fuel flow passages 2 is higher than that applied to the fuel flowing downstream of the guide portions 3. In addition, the pressure applied to fuel flowing upstream of the fuel jet adjusting plate 5 is higher at a location distant from the central axis 10 of the valve body 7 than at a (radially inward) location near the central axis 10. Hence, the pressure applied to the fuel injected from the orifices 6 arranged downstream of the fuel flow passages 2 and along the second circle is higher than that applied to the fuel flowing downstream of the guide portions 3. However, the fuel flowing downstream of the guide portions 3 reaches the orifices 6 arranged along the first smaller diameter circle and is then injected from those orifices 6 under increased pressure. Hence, the pressure applied to the fuel injected from the respective orifices 6 along the first circle, corresponding to the guide portions 3, is substantially equal to that applied to the fuel injected from the respective orifices 6 along the second circle, corresponding to the fuel flow passages 2.

Furthermore, as illustrated in FIG. 6, each of the orifices 6 arranged along the first circle, corresponding to the guide portions 3, is spaced apart by a predetermined distance from a respective one of the orifices 6 arranged along the second circle, corresponding to the fuel flow passages 2. Hence, the fuel injected from the orifices 6 of the fuel injection valve is uniformly atomized. As a result, it is possible to optimize atomization of the fuel injected from all the orifices 6.

Although the aforementioned first to fourth embodiments provide six fuel flow passages 2 and six guide portions 3, implementation of the present invention does not require that the number of the fuel flow passages 2 and the number of the guide portions 3 be specified.

While the present invention has been described with reference to what are presently considered to be preferred embodiments thereof, it is to be understood that the invention is not limited to the disclosed embodiments or constructions. On the contrary, the invention is intended to cover various modifications and equivalent arrangements. In addition, while the various element of the disclosed invention are shown in various combinations and configurations, which are exemplary, other combinations and configurations, including more, less or only a single element, are also within the spirit and scope of the invention.

What is claimed is:

1. A fuel injection valve for an internal combustion engine, comprising:

a valve body driven by driving means;

a valve seat portion having a plurality of guide portions arranged along a circumference of the valve body to slidably guide the valve body and a plurality of fuel flow passages arranged between the guide portions;

a fuel jet adjusting plate arranged downstream of the valve seat portion and attached thereto; and a plurality of first nozzle holes arranged along a first circle on the fuel jet adjusting plate, each first nozzle hole corresponding to a respective one of the guide portions, wherein the first circle is coaxial with the circumference of the valve body.

2. The fuel injection valve according to claim 1, further comprising:

a plurality of second nozzle holes arranged along the first circle on the fuel jet adjusting plate, each second nozzle hole corresponding to a respective one of the fuel flow passages.

3. The fuel injection valve according to claim 1, further comprising:

a plurality of second nozzle holes arranged on the fuel jet adjusting plate along a second circle concentric with the first circle and having a diameter smaller than that of the first circle, each of the second nozzle holes corresponding to a respective one of the fuel flow passages.

4. The fuel injection valve according to claim 1, further comprising:

a plurality of second nozzle holes arranged along a second circle concentric with the first circle and having a diameter larger than that of the first circle, each of the second nozzle holes corresponding to a respective one of the fuel flow passages.

5. The fuel injection valve according to claim 1, wherein the guide portions are arranged around the valve seat portion at predetermined intervals and wherein the nozzle holes are arranged at predetermined intervals along the outer circumference of the valve body.

* * * * *